US008100649B2

(12) United States Patent
Okimura

(10) Patent No.: US 8,100,649 B2
(45) Date of Patent: Jan. 24, 2012

(54) CEILING FAN WITH ROTARY BLADE SURFACE LIGHT

(75) Inventor: Katsuyuki Okimura, Tokyo (JP)

(73) Assignee: NEC Lighting, Ltd., Tokyo (JP)

( * ) Notice: Subject to any disclaimer, the term of this patent is extended or adjusted under 35 U.S.C. 154(b) by 1037 days.

(21) Appl. No.: 12/018,218

(22) Filed: Jan. 23, 2008

(65) Prior Publication Data

US 2008/0213094 A1 Sep. 4, 2008

(30) Foreign Application Priority Data

Feb. 7, 2007 (JP) ..... 2007-027875

(51) Int. Cl.
*F04D 29/00* (2006.01)

(52) U.S. Cl. ..... 416/5; 416/146 R; 416/210 R

(58) Field of Classification Search ..... 416/5, 146 R, 416/210 R; 415/177; 362/555, 612, 35
See application file for complete search history.

(56) References Cited

U.S. PATENT DOCUMENTS

| | | | | |
|---|---|---|---|---|
| 5,082,422 | A * | 1/1992 | Wang | 416/5 |
| 6,037,876 | A * | 3/2000 | Crouch | 340/815.53 |
| 6,193,384 | B1 * | 2/2001 | Stein | 362/96 |
| 6,461,032 | B2 * | 10/2002 | McKinley | 362/555 |

FOREIGN PATENT DOCUMENTS

| | | |
|---|---|---|
| JP | 2003-314487 | 11/2003 |
| JP | 3109730 | 4/2005 |
| JP | 3110299 | 4/2005 |
| JP | 3111819 | 6/2005 |

* cited by examiner

*Primary Examiner* — Ninh H Nguyen
(74) *Attorney, Agent, or Firm* — Young & Thompson

(57) ABSTRACT

In a ceiling fan having a blade surface light, an annular blade surface light including a plurality of LEDs that are light emitters that are continuously placed is secured on a circumference that connects sides near tips of a plurality of rotary blades of the ceiling fan, and the light emitters are lit by a lighting controller only when they are in a predetermined range on a rotation reference circumference. LED devices housing the LEDs that are the light emitters and that are provided with cooling fins are housed in an annular LED case, and the LED case is secured to the rotary blades. Thus, the LEDs radiate heat from the cooling fins provided in the LED devices by rotation of the rotary blades, and they are intermittently lit and extinguished to prevent a temperature increase. The LEDs only in the predetermined range are lit, thereby preventing any uncomfortable feeling when LEDs are caused to flash.

11 Claims, 4 Drawing Sheets

CEILING FAN WITH ROTARY BLADE SURFACE LIGHT

This application is based upon and claims the benefit of priority from Japanese patent application No. 2007-027875, filed on Feb. 7, 2007, the disclosure of which is incorporated herein in its entirety by reference.

BACKGROUND OF THE INVENTION

1. Field of the Invention

The present invention relates to a ceiling fan with a rotary blade surface light, and more particularly to a ceiling fan with a rotary blade surface light for flashing a light source of a light at a predetermined rotation position on a rotary blade.

2. Description of the Related Art

As means for circulating indoor air for comfortable air-conditioned environments, ceiling fans have been used that include a rotating blade placed near a ceiling and that circulate indoor air by the flow of air caused by rotation of the blade. In recent years, ceiling fans having a light including an integrated illumination light have been also used.

Utility Model Registration No. 3109730 discloses a ceiling fan with an illumination device in which a rotary blade having a light source therein and a rotation contact terminal that supplies electric power to the light source are mounted on a rotating shaft extending from a motor, and the rotary blade and the rotating shaft are connected by a flange.

Utility Model Registration No. 3110299 discloses a compact fan in which a fan unit including a blade is mounted on a rotating shaft of a drive motor protruding from a grip, a light emitter that emits light outward in a flashing manner is provided in the fan unit, and the light emitter is placed on the blade. The compact fan supplies electricity to the light emitter via the rotating shaft of the drive motor, and thus displays various light patterns forming multiple circles according to rotation of the blade, which has a strong visual stimulus.

Utility Model Registration No. 3111819 and Japanese Patent Laid-Open No. 2003-314487 also disclose a portable fan in which a light emitting member is placed on a blade or on a blade support, an operation state of the light emitting member is controlled by energization, and blades are rotated to display a pattern or an image on a moving locus of the light emitting member using an afterimage effect of eyes.

In Utility Model Registration No. 3109730, a light source of various types such as a light emitting diode or a fluorescent lamp can be used, but in any cases, the amount of heat corresponding to the input electric power is generated from the light source to increase the temperatures of the light source mounted on the rotary blade.

Light emitting diodes (LED) have been used for illumination because of characteristics thereof of low power consumption, long life, low heat generation, saving space, or the like, but most of high output type LEDs require radiating means such as a heatsink. Without proper radiation, the life and performance of the LED may be significantly shortened and impaired.

Utility Model Registration No. 3109730 does not disclose cooling of the light source and the rotary blade. When the capacity of the light source is small, the temperatures of the light and the rotary blade may be kept within a safe range by radiation from a rotary blade surface, but when the light source requires a larger illumination capacity, the amount of heat generated is increased, and the temperatures of the light and the rotary blade may exceed the safe range.

To solve this problem, radiating means of various types can be provided in incorporating a light source in the light source housing. As specific means for facilitating radiation, it is supposed that a light source is mounted on a printed circuit board using a metal plate having high heat conductivity, or a heatsink is further mounted.

However, in facilitating radiation by such means, a large surface area of a radiator is required for increasing convection to air and radiation efficiency, which increases the size of the light. When the size or structure of the light is restricted, electric power input to the light source needs to be reduced for a balance with radiation, which may prevent desired brightness from being obtained.

Utility Model Registration No. 3110299, Utility Model Registration No. 3111819, and Japanese Patent Laid-Open No. 2003-314487 describe examples flashing light emitting members. However, these examples are intended for displaying various visual light patterns with a portable fan rather than cooling the light emitting member, and cannot be applied to a ceiling fan having a blade surface light intended for illumination.

SUMMARY OF THE INVENTION

The present invention has an object to provide a ceiling fan with a blade surface light that causes a light source to flash at predetermined intervals to prevent a temperature increase.

A ceiling fan with a blade surface light of the present invention includes: a ceiling fan including a plurality of rotary blades; an annular light that is secured to the plurality of rotary blades, includes a plurality of light emitters continuously placed on a circumference concentric with the rotary blades, and is rotated according to rotation of the rotary blades; and a lighting controller that lights the plurality of light emitters only when the light emitters are in a predetermined range on the circumference.

The light emitters are preferably light emitting diodes, and the light may include: LED devices each including the light emitter therein and including a light transmissive surface, a heatsink provided on a surface opposite to the light transmissive surface, and a power supply connector; an annular LED case that can house the LED devices in a connected manner and that includes a bottom surface with a light transmissive surface and mounting members on the rotary blades; and a distribution line that supplies electric power to the power supply connector.

The lighting controller includes: a positive brush provided on an outer surface of a peripheral edge of a rotary blade mounting frame of the ceiling fan and connected to one end of a supply side of the distribution line that supplies electric power to the power supply connector; a plurality of arcuate positive electrodes provided on an inner surface of an outer case surrounding the rotary blade mounting frame and brought into contact with the positive brush; a negative brush provided at a position different from the position of the positive brush on the peripheral edge of the rotary blade mounting frame of the ceiling fan and connected to the other end of the supply side of the distribution line that supplies electric power to the power supply connector; and an annular negative electrode provided on the inner surface of the outer case surrounding the rotary blade mounting frame and brought into contact with the negative brush. The arcuate positive electrode may be provided at a position corresponding to a lighting section of the LED devices of the rotating light, and electric power may be supplied to the positive electrode and the negative electrode from a power supply of the ceiling fan.

The predetermined range on the circumference where the light emitters are lit may be every other range when the circumference is divided into even-numbered ranges, or every other range when the circumference is equiangularly divided into even-numbered ranges, and the number of divided ranges may be 8.

The predetermined range on the circumference where the light emitters are lit may be every two ranges when the circumference is divided into a number of ranges that is an integral multiple of 3, and the number of divided ranges may be 9.

The predetermined range on the circumference where the light emitters are lit may be provided in one place, or may be provided in one place with an angle of 30°.

A light having a function of controlling the flow of air in a room where the light is installed includes a ceiling fan with a light. The ceiling fan has a rotating blade placed near a ceiling, and circulates indoor air by a flow of air caused by rotation of the blade. An LED is placed at a tip or at any position on the rotating blade to facilitate radiation of the LED by the flow of air during rotation. Further, the rotating LED is caused to flash to prevent a temperature increase of the LED.

On the other hand, rotation of a light source causes rotation of a shadow of the illuminated object, which causes an uncomfortable feeling, but the rotating light source is lit in a predetermined range on a rotation circumference, and extinguished outside the range, thereby eliminating the uncomfortable feeling.

In the present invention, the light is provided on the rotary blade surface of the ceiling fan that has a blade surface light, and thus heat generated from a light source is cooled by air brought into contact with the light source by the rotation of the rotary blade, and the light source is caused to flash at regular intervals during rotation to prevent heat generation, and effectively cools the heat generated from the light source.

The light source is lit only in the predetermined rotation range of the rotary blade, thereby reducing movement of the shadow of the illuminated object, and eliminating the uncomfortable feeling caused by flashing.

The above and other objects, features, and advantages of the present invention will become apparent from the following description with reference to the accompanying drawings, which illustrate examples of the present invention.

DETAILED DESCRIPTION OF THE PREFERRED EMBODIMENT

Figure 1:
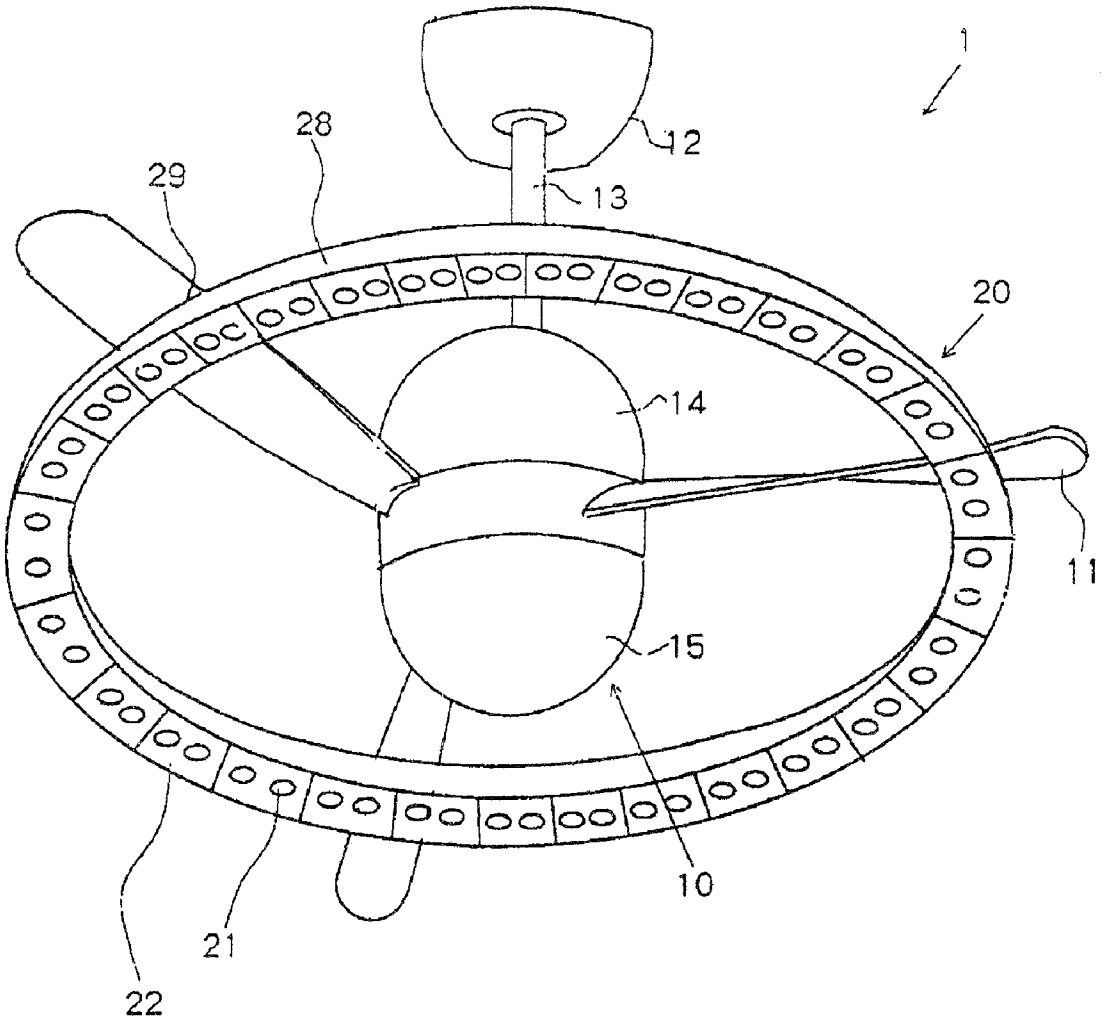
FIG. 1 is a perspective view of a ceiling fan with a blade surface light of an exemplary embodiment of the present invention.

An exemplary embodiment of the present invention will be described with reference to the drawings. FIG. 1 is a perspective view of a ceiling fan with a blade surface light of an exemplary embodiment of the present invention.

Ceiling fan having blade surface light 1 of the exemplary embodiment of the present invention includes ceiling fan 10, and annular blade surface light 20 secured at light mounting portions 29 to lower surfaces near the tips of rotary blades 11 of ceiling fan 10. In this case, providing the annular blade surface light 20 closer to the tips of the rotary blades 11 increases a moving speed of LEDs 21 and more effectively facilitates radiation from radiating fins 23 described later. The LEDs are used as light sources, but not limited to this, any light sources that can be continuously placed in the blade surface light housing, for example, small light bulbs may be used.

Ceiling fan 10 is secured to the ceiling by an mounting tool, not shown, in ceiling cap 12. Rotary blades 11 are rotationally driven together with bowl-like portion 15 by a motor that engages a shaft in ceiling cap 12 and pipe 13. Three rotary blades 11 are herein provided, but not limited to this, any number of blades may be provided as long as the blades can stably hold blade surface light 20.

The ceiling fan itself is a known technique, and a detailed description thereof will be omitted. Blade surface light 20 of the present invention can be mounted to rotary blades 11 and continuously operated, and any ceiling fan 10 can be used as ceiling fan with blade surface light 1 as long as it can supply electric power to blade surface light 20. Blade surface light 20 of the present invention can be mounted on a conventional ceiling fan with integrated lights for reinforcing illumination to form a ceiling fan having a blade surface light of the present invention.

Figure 2C:
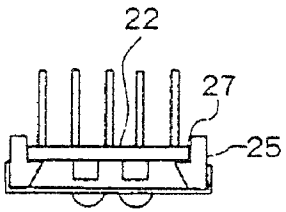
FIG. 2C is an A-A sectional view of FIG. 2B.
Figure 2D:
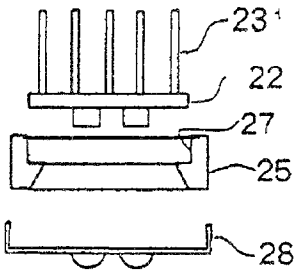
FIG. 2D is a sectional view of a state where the LED device and a case cover are removed from the LED case of the exemplary embodiment of the present invention.
Figure 2B:
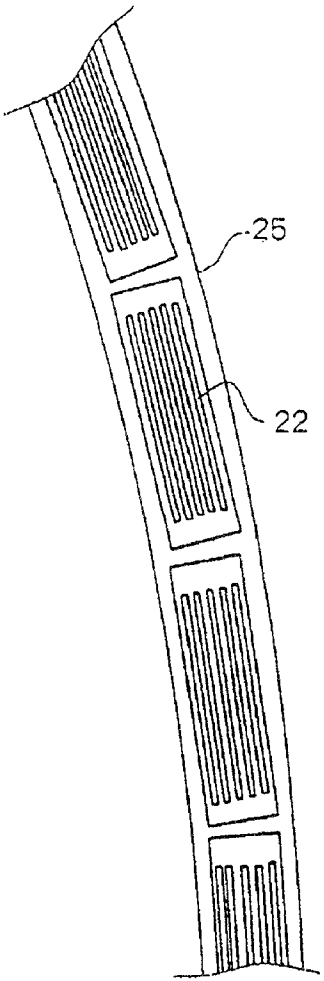
FIG. 2B is a schematic partial top view of a state where an LED device is mounted in the LED case of the exemplary embodiment of the present invention.
Figure 2A:
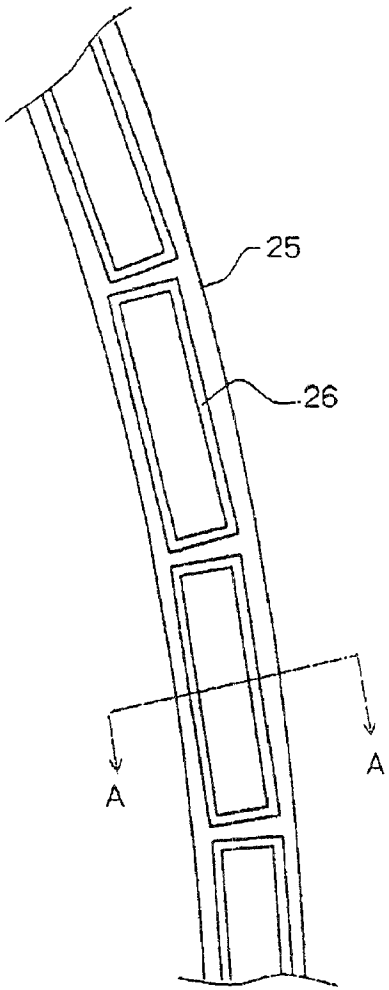
FIG. 2A is a schematic partial top view of an LED case of a blade surface light of the exemplary embodiment of the present invention.

FIG. 2A is a schematic partial top view of an LED case of the blade surface light of the exemplary embodiment of the present invention. FIG. 2B is a schematic partial top view of a state where an LED device is mounted in the LED case of the exemplary embodiment of the present invention. FIG. 2C is an A-A sectional view of FIG. 2B. FIG. 2D is a sectional view of a state where the LED device and the case cover are removed from the LED case of the exemplary embodiment of the present invention.

Figure 3A:
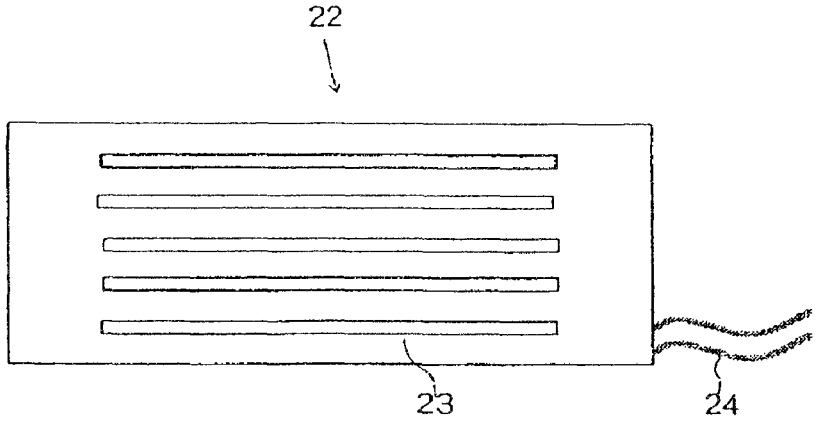
FIG. 3A is a schematic top view of the LED device of a blade surface light of the exemplary embodiment of the present invention.
Figure 3B:
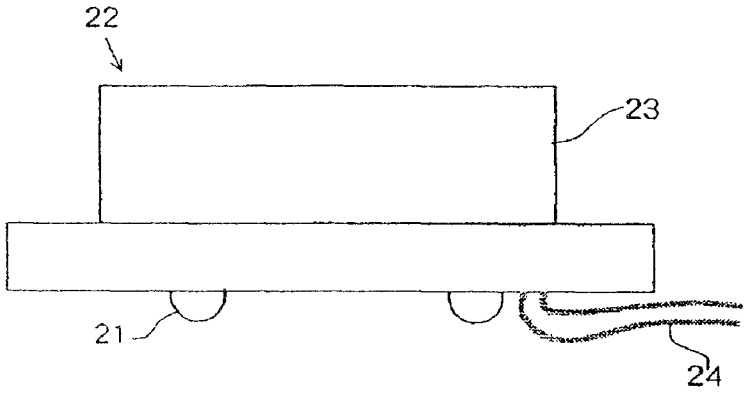
FIG. 3B is a schematic longitudinal side view of the LED device of the blade surface light of the exemplary embodiment of the present invention.
Figure 3C:
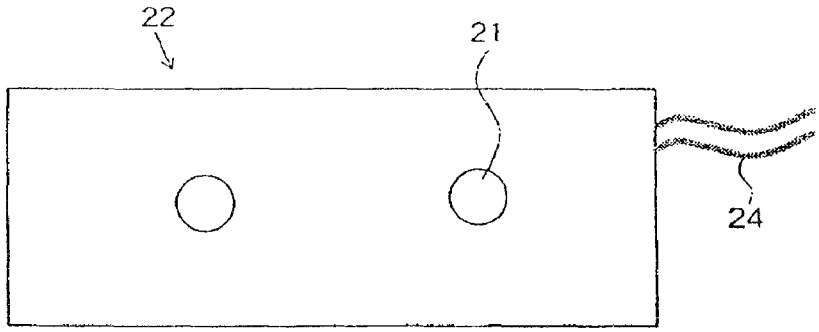
FIG. 3C is a schematic bottom view of the LED device of the exemplary embodiment of the present invention.
Figure 3D:
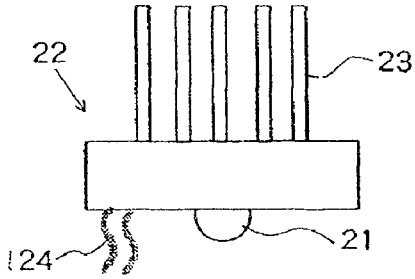
FIG. 3D is a schematic transverse side view of the LED device of the exemplary embodiment of the present invention.

FIG. 3A is a schematic top view of the LED device of the blade surface light of the exemplary embodiment of the present invention. FIG. 3B is a schematic longitudinal side view of the LED device of the blade surface light of the exemplary embodiment of the present invention. FIG. 3C is a schematic bottom view of the LED device of the exemplary embodiment of the present invention. FIG. 3D is a schematic transverse side view of the LED device of the exemplary embodiment of the present invention.

Blade surface light 20 includes LED devices 22 mounted with LEDs 21, and annular LED case 25 in which device housings 26 that house LED devices 22 are continuously provided, and LED case 25 is secured at light mounting portions 29 on a predetermined circumference of rotary blades 11.

LED device 22 is mounted with LEDs 21 having light emitting portions exposed on one surface, and, on a surface opposite to the surface with LEDs 21, radiating fins 23 are provided in parallel with the rotational direction of LED case 25. Feeder line 24 for supplying electric power to LED 21 is drawn into rotary blade 11 via the inside of LED case 25 and light mounting portion 29 and reaches a feeding brush in lighting controller 30 in bowl-like portion 15 via rotary blade 11. Electric power is supplied to LED 21 via an electrode connecting to a power supply of ceiling fan 10, the feeding brush, and feeder line 24. LED device 22 herein includes two LEDs 21, but not limited to two, LED device 22 may have one or three or more LEDs according to illumination design.

Device housings 26 are continuously provided in LED case 25, and LED devices 22 inserted through openings are secured to device mounting portion 27. A surface opposite to the insertion side of LED device 22 of device housing 26 forms removable case cover 28, and a light transmissive window is provided in a surface of case cover 28 facing LEDs 21.

Figure 4A:
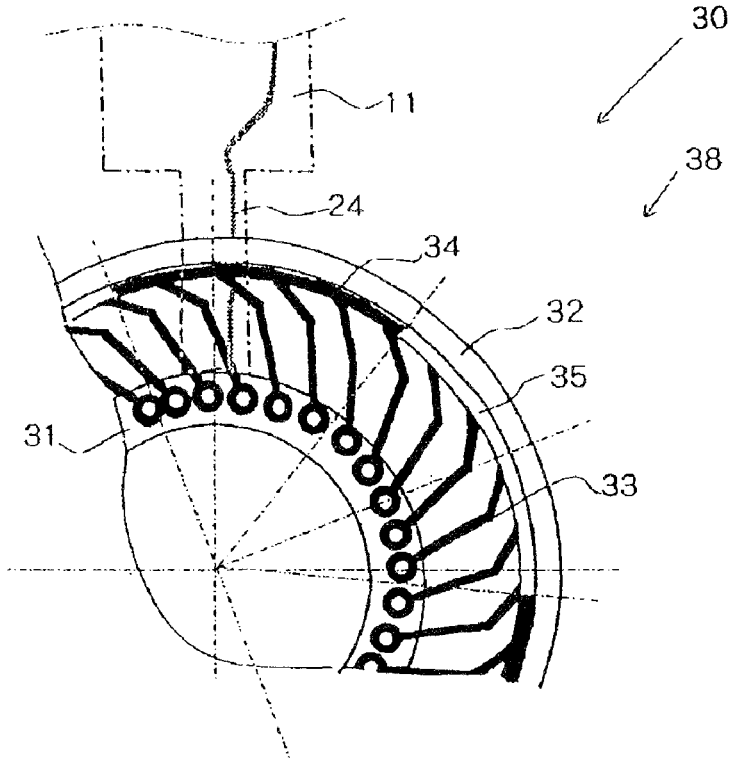
FIG. 4A is a schematic partial sectional view of a positive electrode of a lighting controller.
Figure 4B:
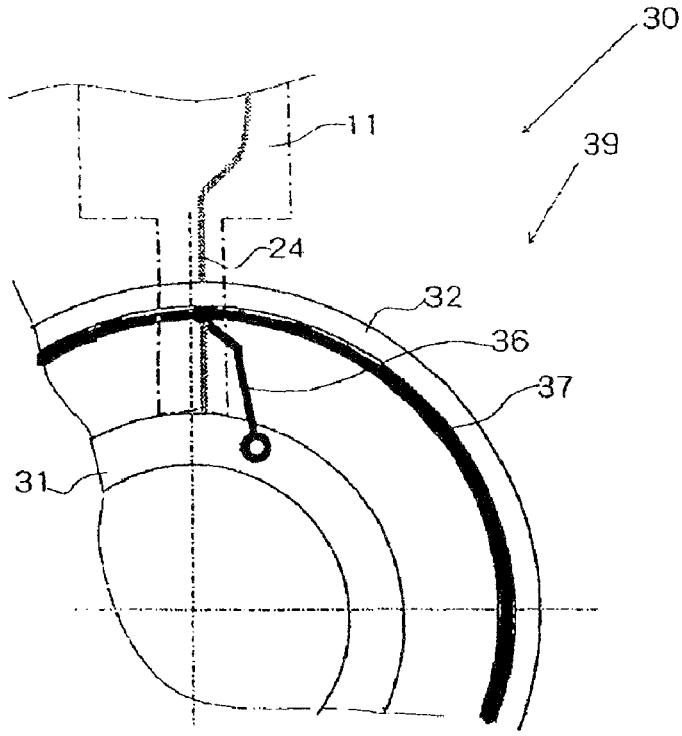
FIG. 4B is a schematic partial sectional view of a negative electrode of the lighting controller.

FIG. 4A is a schematic partial sectional view of a positive electrode of the lighting controller, and FIG. 4B is a schematic partial sectional view of a negative electrode of the lighting controller.

Electric power is herein rectified in the ceiling fan and supplied to LED device 22 as positive and negative currents, but electric power may be supplied by AC power and rectified in LED device 22.

Two step electric power supply units: positive first step electric power supply unit 38 and negative second step electric power supply unit 39 are provided in rotating boss 31 mounted with rotary blades 11 to rotate rotary blades 11.

As shown in FIG. 4A, in first step electric power supply unit 38, positive brushes 33 corresponding to LED devices 22 housed in LED case 25 are provided in rotating boss 31. Positive feeder lines 24 from corresponding LED devices 22 are connected to respective positive brushes 33. Positive brushes 33 provided in rotating boss 31 are rotated according to the rotation of rotary blades 11. In first step electric power supply unit 38 provided inside motor cover 14 secured to the ceiling, positive electrodes 34 and positive insulators 35 brought into slide contact with positive brushes 33 are alternately placed. Positive electrodes 34 are connected to a positive terminal of a rectifier, not shown.

As shown in FIG. 4B, one negative brush 36 is provided in second step electric power supply unit 39. Negative feeder lines 24 from all LED devices 22 are connected to negative brush 36. Negative brush 36 is rotated according to the rotation of rotary blade 11. At a position facing second step electric power supply unit 39 of motor cover 14 secured to the ceiling, negative electrode 37 brought into slide contact with negative brush 36 is placed around the circumference, and negative electrode 37 is connected to a negative terminal of the rectifier, not shown. A plurality of negative brushes 36 may be provided, not limited to one.

Positive electrodes 34 are provided correspondingly to ranges where rotating LED devices 22 are to be continuously lit. In this example, thirty LED devices 22 are housed in LED case 25 at regular intervals, and three sets of positive electrodes 34 with which five positive brushes 33 are simultaneously brought into contact are provided in pairs with adjacent positive insulators 35 of the same size as positive electrodes 34.

Thus, LED devices 22 flash three times at regular intervals during one rotation of LED case 25, and the cumulative length of the lighting time is equal to the extinguishing time. Lighting positions are always fixed, which does not cause movement of a shadow of an illuminated object by when the LED devices flash, and does not provide uncomfortable feeling to people.

The lighting and extinguishing ranges and the flashing positions during one rotation are not limited to the example, but can be freely set according to the design of positive electrode 34 and positive insulator 35. Thus, positive electrode 34 may be designed by keeping in mind the number of times that LED devices may be flashed, the lighting and extinguishing ranges and the flashing position of the LED devices.

When illumination is to be brightened or darkened according to the time, first step electric power supply unit 38 can be switched to a bright or dark mode. This exemplary embodiment is based on a case in which there is a risk that a temperature increase may impair continuous lighting of LED devices 22, but without such a risk, the bright side of first step electric power supply unit 38 may be continuously lit and the dark side of first step electric power supply unit 38 may be used for darkening the illumination.

In the shown exemplary embodiment, thirty sets of LED devices 22 each including two LEDs 21 each having a light flux of 100 Im are housed in LED case 25. Thus, when all the LEDs are lit, the total light flux is 6000 Im, and when half the LEDs are lit, the light flux is 3000 Im, which is substantially the same as a light flux of a tubular fluorescent lamp of 40 w. The light flux and the number of LEDs 21 may be selected according to the desired amount of light flux.

Thus, in the exemplary embodiment of the present invention, radiating fins 23 are provided on LED devices 22 to increase air cooling efficiency, and LEDs 21 are intermittently flashed, thereby solving the problem of a temperature increase of LEDs 21. Further, the lighting and extinguishing positions are fixed to eliminate any uncomfortable feelings caused by movement of a shadow of an illuminated object.

While preferred embodiments of the present invention have been described using specific terms, such description is for illustrative purposes only, and it is to be understood that changes and variations may be made without departing from the spirit or scope of the following claims.

What is claimed is:

1. A ceiling fan with a rotary blade surface light comprising:

a ceiling fan including a plurality of rotary blades;

an annular light that is secured to said plurality of rotary blades, includes a plurality of light emitters continuously placed on a circumference concentric with said rotary blades, and is rotated according to rotation of said rotary blades; and a lighting controller that lights said plurality of light emitters only when said plurality of light emitters are in a predetermined range on said circumference.

2. The ceiling fan having a rotary blade surface light according to claim 1, wherein said light emitters are light emitting diodes.

3. The ceiling fan having a rotary blade surface light according to claim 1, wherein said light comprises:

LED devices each including said light emitter therein and including a light transmissive surface, a heatsink provided on a surface opposite to said light transmissive surface, and a power supply connector;

an annular LED case that can house said LED devices in a connected manner and includes a bottom surface that is light transmissive surface and members mounted onto said rotary blades; and a distribution line that supplies electric power to said power supply connector.

4. The ceiling fan with a rotary blade surface light according to claim 3, wherein said lighting controller comprises:

a positive brush provided on an outer surface of a peripheral edge of a rotary blade mounting frame of said ceiling fan and connected to one end of the side of the distribution line that supplies electric power to said power supply connector;

a plurality of arcuate positive electrodes provided on an inner surface of an outer case surrounding said rotary blade mounting frame of said ceiling fan and brought into contact with said positive brush;

a negative brush provided at a position different from the position of said positive brush on the peripheral edge of said rotary blade mounting frame of said ceiling fan and connected to the other end of the side of the distribution line that supplies electric power to said power supply connector; and an annular negative electrode provided on the inner surface of the outer case surrounding said rotary blade mounting frame of said ceiling fan and brought into contact with said negative brush, and said arcuate positive electrode is provided at a position corresponding to a lighting section of said LED devices of said rotating light, and electric power is supplied to said positive electrode and said negative electrode from a power supply of said ceiling fan.

5. The ceiling fan having a rotary blade surface light according to claim 1, wherein the predetermined range on said circumference where said light emitters are lit is every other range when said circumference is divided into even-numbered ranges.

6. The ceiling fan having a rotary blade surface light according to claim 5, wherein the predetermined range on said circumference where said light emitters are lit is every other range when said circumference is equiangularly divided into even-numbered ranges.

7. The ceiling fan having a rotary blade surface light according to claim 6, wherein the number of divided ranges is 8.

8. The ceiling fan having a rotary blade surface light according to claim 1, wherein the predetermined range on said circumference where said light emitters are lit is every two ranges when said circumference is divided into a number of ranges that is an integral multiple of 3.

9. The ceiling fan having a rotary blade surface light according to claim 8, wherein the number of divided ranges is 9.

10. The ceiling fan having a rotary blade surface light according to claim 1, wherein the predetermined range on said circumference where said light emitters are lit is provided in one place.

11. The ceiling fan having a rotary blade surface light according to claim 10, wherein the predetermined range on said circumference where said light emitters are lit is provided in one place with an angle of 30°.

* * * * *